US007261640B1

(12) United States Patent
Baggott

(10) Patent No.: US 7,261,640 B1
(45) Date of Patent: Aug. 28, 2007

(54) GOLF ALIGNMENT AID

(76) Inventor: Preston Baggott, 4293-48B Street, Ladner, British Columbia (CA) V4K 2R3

( * ) Notice: Subject to any disclaimer, the term of this patent is extended or adjusted under 35 U.S.C. 154(b) by 0 days.

(21) Appl. No.: 11/455,781

(22) Filed: Jun. 20, 2006

(51) Int. Cl.
*A63B 69/36* (2006.01)

(52) U.S. Cl. ..... 473/270; 473/272

(58) Field of Classification Search ..... 473/218, 473/266, 270, 271, 272, 273
See application file for complete search history.

(56) References Cited

U.S. PATENT DOCUMENTS

| | | | | |
|---|---|---|---|---|
| 2,169,407 A | | 8/1939 | Crowley | |
| 3,229,981 A | * | 1/1966 | Taber | 473/272 |
| 4,322,084 A | | 3/1982 | Reece et al. | |
| 4,718,674 A | | 1/1988 | Henry | |
| 5,110,132 A | | 5/1992 | Weston et al. | |
| 5,246,234 A | | 9/1993 | Zambelli | |
| 5,350,177 A | | 9/1994 | Furbush, Jr. | |
| 5,411,266 A | | 5/1995 | Guthry | |
| 5,464,220 A | | 11/1995 | Hansen et al. | |
| 5,707,301 A | | 1/1998 | Tollin | |
| 5,984,801 A | * | 11/1999 | Mason | 473/270 |
| 6,106,408 A | | 8/2000 | Roman | |
| 6,723,003 B1 | * | 4/2004 | Harrell | 473/270 |

FOREIGN PATENT DOCUMENTS

| | | |
|---|---|---|
| CA | 2091823 | 9/1994 |
| GB | 2305612 A | 9/1995 |
| GB | 2333966 A | 2/1998 |

* cited by examiner

*Primary Examiner*—Nini F. Legesse
(74) *Attorney, Agent, or Firm*—Cameron IP

(57) ABSTRACT

The invention relates to a golf stance aid for a golfer. It includes a foot alignment member along which the golfer's feet align. There is a ball alignment member that is parallel to the foot alignment member and along which a golf ball aligns. There is also a first connection member and a second connection member. These connection members pivotally connect the foot alignment member and the ball alignment member to form an adjustable parallelogram structure. There is a measuring member which attaches to the ball alignment member. The measuring member spans the distance between the foot alignment member and the ball alignment member. The measuring member has means for retaining indicia for recording changes in distance between the golf ball as aligned with the ball alignment member and the golfer's feet as aligned with the foot alignment member.

17 Claims, 3 Drawing Sheets

GOLF ALIGNMENT AID

BACKGROUND OF THE INVENTION

Traditionally, golf stance aid devices have had numerous parts and a wide array of adjustment features. An example of this is seen in U.S. Pat. No. 5,246,234. The number of different features in this patent that need to be adjusted may become tedious for golfers. Furthermore, for novice golfers these numerous features can be very overwhelming. At the other extreme, there exist golf stance aid devices which are too simplistic—merely allowing the golfers to align themselves perpendicular to the ball. The need for a user-friendly but not simplistic golf stance aid for novice golfers is thus apparent.

One of the inventor's solutions to this problem is to present a device which allows the golfer to remain perpendicular to the ball and additionally obtain a desired separation distance from the golfer's feet to the ball. More specifically, the invention involves the use an adjustable parallelogram structure that allows the golfer's feet to align perpendicular to the ball. There is also a measuring bar which spans the distance separating the ball and golfer's feet. The measuring member is used to replicate the desired distance of separation between the ball and golfer's feet.

In one embodiment of the invention, the measuring member has means for retaining indicia. When a golfer takes golf lessons, a golf instructor will provide the golfer with the correct distance of separation between the ball and golfer's feet for a given golf club and golfer body-type. To precisely record this separation distance, the golf stance aid device allows the golfer to make indicia on the measuring member for each of the different positions. This thereby allows the golfer at a later time to practice with the correct golf stance, without the expense of continually having a golf instructor nearby.

A variation on the above invention involves the measuring member having pre-set indicia, varying according to such variables as the club to be used. This thereby eliminates the need to incorporate the golf instructor's advice.

BRIEF SUMMARY OF THE INVENTION

One aspect of this invention involves a golf stance aid for a golfer. It comprises a foot alignment member along which the golfer's feet align. There is a ball alignment member that is parallel to the foot alignment member and along which a golf ball aligns. There is also a first connection member and a second connection member. These connection members pivotally connect the foot alignment member and the ball alignment member to form an adjustable parallelogram structure. There is a measuring member which attaches to the ball alignment member. The measuring member spans the distance between the foot alignment member and the ball alignment member. The measuring member has means for retaining indicia for recording changes in distance between the golf ball as aligned with the ball alignment member and the golfer's feet as aligned with the foot alignment member.

According to another aspect, the invention involves a measuring member which has a set of indicia. Specific indicium correspond to a specific type of golf club and a recommended distance of separation between the golf ball as aligned by the ball alignment member and the golfer's feet as aligned by the foot alignment member.

Alternatively, the invention can be described as involving a method of achieving a set golf stance. The method involves first placing in front of a golfer's feet a golf stance aid. The golf stance aid comprises a foot alignment member and a ball alignment member which is parallel to the foot alignment member. The golf stance aid further comprises a first connection member and a second connection member. These connection members pivotally connect the foot alignment member and ball alignment member to form an adjustable parallelogram structure. The golf stance aid also has a measuring member connected to the ball alignment member. The measuring member spans the distance between the foot alignment member and ball alignment member.

The method next involves aligning the golfer's feet with the foot alignment member. A golf ball is then aligned with the ball alignment member. Next, the golfer adjusts the distance between the foot alignment member and ball alignment member. This is done by manipulating the adjustable parallelogram structure of the golf stance aid until a desired distance between the golfer's feet and golf ball is obtained. The golfer then marks an indicia on the measuring member corresponding to the said desired distance for future reference.

According to another aspect, the invention involves a method where the measuring member has a set of indicia. Specific indicium correspond to a specific type of golf club and a recommended distance of separation between the golf ball as aligned by the ball alignment member and the golfer's feet as aligned by the foot alignment member. The golfer thus manipulates the adjustable parallelogram structure of the golf stance aid until a set distance between the golfer's feet and golf ball is obtained, as determined by the set of indicia of the measuring member.

BRIEF DESCRIPTION OF THE DRAWINGS

Referring to the drawings.

DESCRIPTION OF THE PREFERRED EMBODIMENTS

Figure 1:
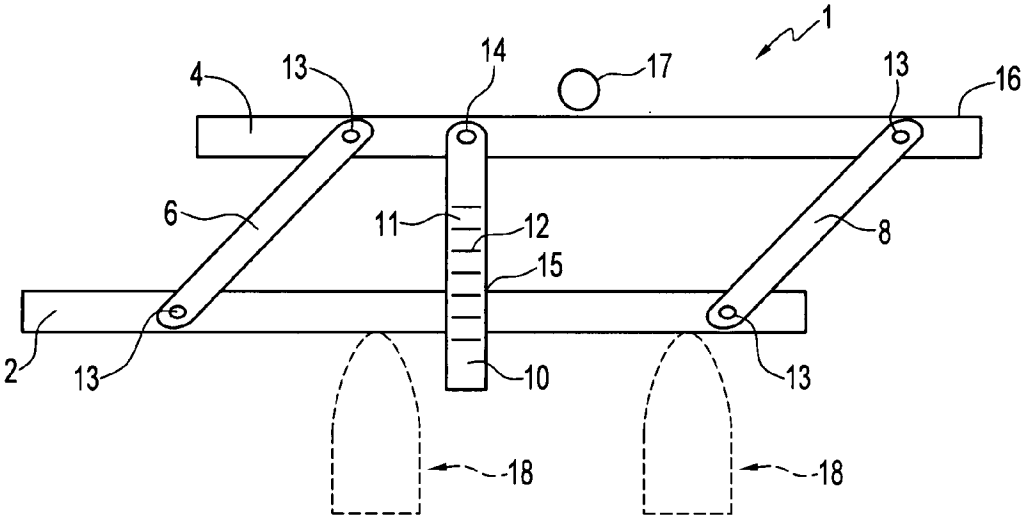
FIG. 1 is a top view of the preferred embodiment of the golf stance aid.

Referring to the drawings and first to FIG. 1, a golf stance aid apparatus is shown generally at 1. The apparatus includes a foot alignment member 2 which aligns along a golfer's feet 18, and a ball alignment member 4 which aligns with a golf ball 17. The foot alignment member 2 and ball alignment member 4 are pivotally connected with pivots 13 by first connection member 6 and second connection member 8, respectively. An adjustable parallelogram structure is thus formed by foot alignment member 2, ball alignment member 4, first connection member 6, second connection member 8, and pivots 13.

The apparatus further includes a measuring member 10 which in this embodiment is pivotally connected to ball alignment member 4 by pivot 14. Measuring member 10 has means 11 for retaining indicia 12. The indicia 12 are used for recording changes in distance between the golf ball 17 as aligned with the ball alignment member 4 and a golfer's feet 18 as aligned by the foot alignment member 2. The indicia 12 can be obtained based on the instructions of a golf instructor. The indicia 12 can be read in relation to the foot alignment member 2; that is, the measuring member can be used in reference to a point of intersection 15 with the foot alignment member 2. The indicia 12 correspond to a specific type of golf club and a recommended distance of separation between the golf ball 17 and the golfer's feet 18.

The indicia 12 can be read in relation to the foot alignment member 2; that is, the measuring member 10 can be used in reference to a point of intersection 15 with the foot alignment member 2.

Figure 4:
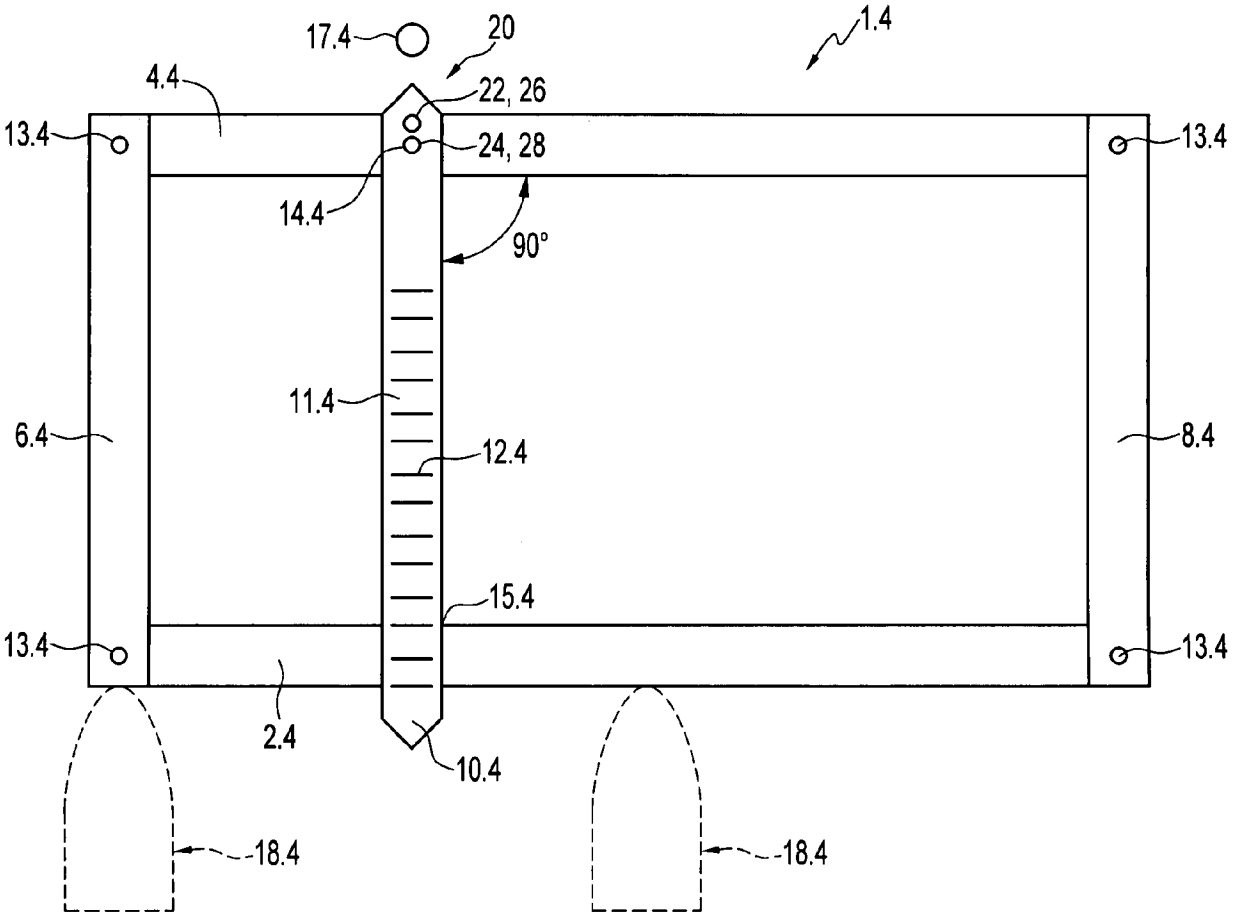
FIG. 4 is an alternative embodiment similar to FIG. 1, including two holes in the members for fixing the measuring member angle relative to the ball alignment member.

A further embodiment is shown in FIG. 4, where this shows a variation generally similar to the previous embodiment and like parts have like numbers with the additional designation "0.4". In this embodiment, shown is a means 20 for fixing a set angle at which the measuring member 10.4 crosses both the foot alignment member 2.4 and ball alignment member 4.4. This means is exemplified by two holes 22 and 24, respectively in the measuring member 10.4 adjacent to the position where the measuring member 10.4 attaches to the ball alignment member 4.4, and two corresponding holes, 26 and 28, respectively, in the ball alignment member 4.4. The means 20 for fixing a set angle is achieved by aligning these said holes 22 and 26, with holes 24 and 28, respectively. This enables the measuring member 10.4 to be at 90 degrees to the foot alignment member 2.4.

The embodiment in FIG. 4 also shows that measure member 10.4 can acts as a further alignment indicator for golf ball 17.4, in addition to the golf ball 17.4 alignment with the ball alignment member 4.4. Elaborating, the golf ball 17 in this embodiment should be placed substantially parallel to measure member 4.4.

Figure 2:
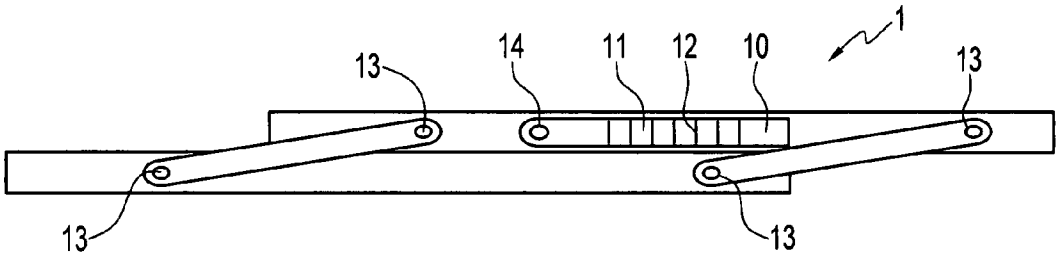
FIG. 2 is a top view similar to FIG. 1 with the golf stance aid is shown in collapsed form.

FIG. 2 shows the golf stance aid apparatus 1 in collapsed form. The pivots 13 and 14 enable the foot alignment member 2, ball alignment member 4, first connection member 6, second connection member 8, and measuring member 10 to alignment in a substantially parallel manner. This allows for easy storage of the golf stance aid apparatus 1.

For the embodiments shown in FIGS. 1 and 2, all of the said members are bars made of steel with a protective paint coating 16. It will be appreciated, however, by those skilled in the art, that a number of variations of the invention are possible, including the members being made of such materials as other alloys, types of plastic, and types of graphite.

Figure 3:
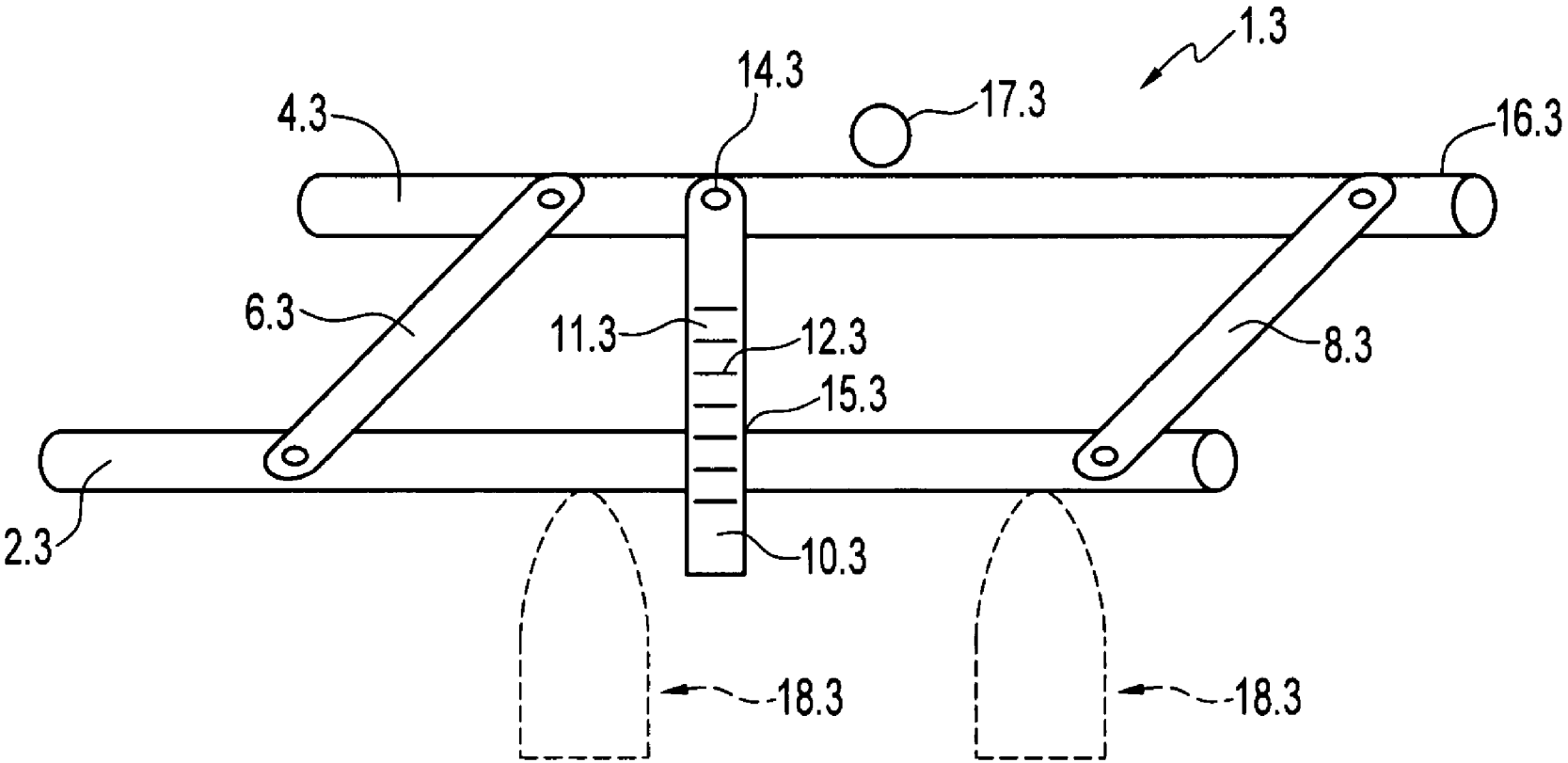
FIG. 3 is a top plan view of an alternative embodiment where the members are tubes.

A further alternative embodiment is shown in FIG. 3, generally similar to the previous embodiment and where like parts have like numbers with the additional designation "0.3". In this example, instead of bars, tubes are used for foot alignment member 2.3, ball alignment member 4.3, first connection member 6.3, second connection member 8.3, and measuring member 10.3.

As merely by way of example, dimensions for the golf alignment aid apparatus 1 in one embodiment of the invention can be as follows. The measuring member 10 is 30 inches in length. Both the foot alignment member 2 and ball alignment member 4 are 48 inches in length. The measuring member 10 is 12 inches to the right (from the perspective of FIG. 1) of the first connection member 6. The measuring member 10 is 24 inches to the left (from the perspective of FIG. 1) of the second connection member 8. The pivots 13 and 14 are hinges are ⅜ inch carriage bolts with wing nuts.

It will be understood by someone skilled in the art that many of the details provided above are by way of example only and are not intended to limit the scope of the invention which is to be determined with reference to the following claims.

What is claimed is:

1. A golf stance aid for a golfer comprising:

a foot alignment member along which the golfer's feet align;

a ball alignment member which is parallel to the foot alignment member and along which a golf ball aligns;

a first connection in member and a second connection member, the connection members pivotally connecting the foot alignment member and the ball alignment member to form an adjustable parallelogram structure;

a measuring member which attaches to the ball alignment member and spans the separating distance between the foot alignment member and the ball alignment member, the measuring member having means for retaining indicia for recording changes in distance between the golf ball as aligned with the ball alignment member and the golfer's feet as aligned with the foot alignment member, the measuring member having a point of intersection between the foot alignment member and the measuring member, said point of intersection aligning to corresponding indicium on the measuring member; and means for fixing a set angle at which the measuring member crosses both the foot alignment member and the ball alignment member, said means for fixing a set angle including two holes on the measuring member adjacent to a position where the measuring member attaches to the ball alignment member and two corresponding holes on the ball alignment member, the holes on the measuring member being alignable with the holes on the ball alignment to fix the set angle.

2. The apparatus as claimed in claim 1, wherein the measuring member has a set of indicia where a specific indicium corresponds to a specific type of golf club and a recommended distance of separation between the golf ball as aligned by the ball alignment member and the golfer's feet as aligned by the foot alignment member.

3. The apparatus as claimed in claim 2, wherein the set angle for fixing the measuring member is 90 degrees.

4. The apparatus as claimed in claim 3, wherein the golf ball further aligns to be substantially parallel to said measure member.

5. The apparatus as claimed in claim 3, wherein the members are made of a steel.

6. The apparatus as claimed in claim 5, wherein said members are bars.

7. The apparatus as claimed in claim 6, wherein the members have a protective paint coating.

8. The apparatus as claimed in claim 7, wherein the members have means for collapsing for easy storage.

9. The apparatus as claimed in claim 5, wherein said members are tubes.

10. A method of achieving a set golf stance for a golf stance aid comprising a foot alignment member, a ball alignment member which is parallel to the foot alignment member, a first connection member and a second connection member, the connection members being pivotally connected together so that the foot alignment member and the ball alignment member form an adjustable parallelogram structure, and a measuring member which has a set of indicia, attaches to the ball alignment member and spans the distance between the foot alignment member and the ball alignment member, said method comprising:

placing in front of a golfer's feet a golf stance aid;

aligning the golfer's feet with the foot alignment member;

aligning a golf ball with the ball alignment member;

adjusting the distance between the foot alignment member and the ball alignment member by manipulating the adjustable parallelogram structure until a desired distance between the golfer's feet and the golf ball is obtained;

marking an indicium on the measuring member corresponding to said desired distance for future reference; and adjusting the distance between the foot alignment member and the ball alignment member by manipulating the adjustable parallelogram structure until a set distance between the golfers' feet and the golf ball is obtained, as determined by the set of indicia of the measuring member, wherein for the set of indicia, specific indicium is determined by each type of golf club to be used.

11. The method in claim 10, including the step of using a point of intersection between the foot alignment member and measuring member to identify specific indicium on the measuring member.

12. The method in claim 11, including, after aligning the measuring member, the step of using a means for fixing a set angle of 90 degrees at which the measuring member crosses both the foot alignment member and ball alignment member.

13. The method in claim 12, including providing two holes in said measuring member and two corresponding holes in said ball alignment member; and aligning said holes so as to fix the set angle at which the measuring member crosses both the foot alignment member and ball alignment member.

14. The method as claimed in claim 13, including the steps of making the members for the golf stance aid of steel; and coating the members of the golf stance aid with a protective paint.

15. The method as claimed in claim 14, including the step of using bars as the members for the golf stance aid.

16. The method as claimed in claim 15, including the step of using tubes as the members for the golf stance aid.

17. The method of claim 16, including after having finished using the golf stance aid the step of collapsing the members of the golf stance aid for easy storage.

* * * * *